US007456569B2

(12) United States Patent
Wieβmeier et al.

(10) Patent No.: US 7,456,569 B2
(45) Date of Patent: Nov. 25, 2008

(54) LIGHT-EMITTING, TRANSPARENT FILM SYSTEM BASED ON POLYMERS

(75) Inventors: Georg Wieβmeier, Tokyo (JP); Eckard Foltin, Sinzig (DE); Jürgen Röhner, Köln (DE)

(73) Assignee: Lyttron Technology GmbH, Cologne (DE)

( * ) Notice: Subject to any disclaimer, the term of this patent is extended or adjusted under 35 U.S.C. 154(b) by 398 days.

(21) Appl. No.: 11/188,687

(22) Filed: Jul. 25, 2005

(65) Prior Publication Data

US 2006/0022591 A1 Feb. 2, 2006

(30) Foreign Application Priority Data

Jul. 28, 2004 (DE) ..... 10 2004 036 549

(51) Int. Cl.
*H01J 63/04* (2006.01)

(52) U.S. Cl. ..... 313/511; 313/506

(58) Field of Classification Search ..... None
See application file for complete search history.

(56) References Cited

U.S. PATENT DOCUMENTS 5,069,815 A 12/1991 Aoki et al. ..... 252/301.36
5,672,937 A 9/1997 Choi et al. ..... 313/503
5,780,965 A 7/1998 Cass et al. ..... 313/498
6,637,906 B2 10/2003 Knoerzer et al. ..... 362/84
2004/0251986 A1 12/2004 Heise et al. ..... 333/131

OTHER PUBLICATIONS

Pearlthane 11T85 Datasheet (http://web.archive.org/web/20060511212218/www.merquinsa.com/p_info/pearlthane/11T85.pdf).*
Merquinsa Pearlthane (http://web.archive.org/web/20040624201255/http://www.merquinsa.com/p_info/pearlthane.asp).*
Efunda, "http://www.efunda.com/materials/polymers/properties/polymer_cat.cfm?MajorID=PU", Accessed on Jan. 17, 2008.*
Database Inspec 'Online! The institution of Electrical Engineers, Stevenage, GB, 2001, Yi He et al: "Polyfluorene light emitting device on flexible plastic substrates" XP002357539 Database accession No. 7148225 * Zusammenfassung * & Organic Light-Emitting Materials and Devices IV Jul. 31-Aug. 2, 2000 San Diego, CA, USA, Bd. 4105, Feb. 2001, Seiten 143-151, Proceedings of the SPIE—The International Society for Optical Engineering SPI-Int. Soc. Opt. Eng USA.

* cited by examiner

*Primary Examiner*—Toan Ton
*Assistant Examiner*—Britt Hanley
(74) *Attorney, Agent, or Firm*—Lyndanne M. Whalen; John E. Mrozinski, Jr.

(57) ABSTRACT

A light-emitting, transparent, flexible film system based on polymers is produced by including a thermoplastic polyurethane film having an electroluminescent pigment incorporated therein in the flexible film system. These systems are useful as a luminescent system.

5 Claims, 1 Drawing Sheet

LIGHT-EMITTING, TRANSPARENT FILM SYSTEM BASED ON POLYMERS

BACKGROUND OF THE INVENTION

Figure 1:
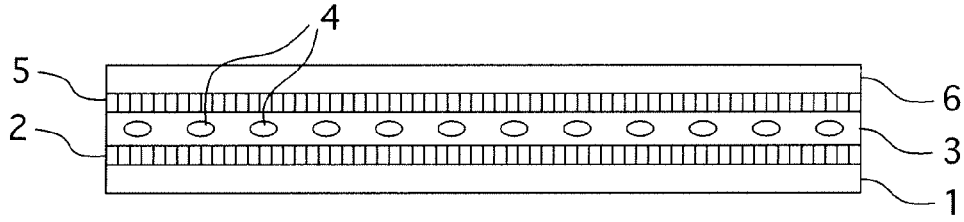

The present invention relates to a light-emitting, transparent, optionally flexible film system based on polymers, to a process for its production and to its use.

WO03/037031 and U.S. Pat. No. 5,780,965 describe light-emitting film systems which are formable and onto the back of which a material can be injected. In a first production step, the graphic design, the material for the front, transparent electrode, the inorganic luminescent agent and the material for the back electrode are printed onto a transparent substrate. When this film system is used directly, the back is insulated, for example, by means of a protective film. However, it is also possible for the system to be pre-formed after the printing process and then inserted into an injection-molding tool, in which a material is injected onto its back. By way of contacts attached to the electrodes in a suitable manner, it is possible to apply an alternating voltage field (e.g., 110 V, 400 Hz) with the aid of an inverter and to excite the luminescent agent for the emission of light. In U.S. Pat. No. 5,780,965, the material used for the transparent electrode is, for example, indium-doped tin oxide (ITO). In WO03/037031, Baytrone® chemicals for the production and processing of conductive substances which are commercially available from H.C. Stark GmbH & Co. KG are disclosed. The advantage of Baytron® chemicals over ITO is their better formability. The luminescent agent—which is generally doped tin oxides or tin sulfides—is dispersed in a paste suitable for a screen printing process. Such luminescent film systems have been used substantially for small-area applications because, inter alia, production is complex and the costs are high.

SUMMARY OF THE INVENTION

The object of the present invention was, therefore, to provide a large-area, light-emitting film system based purely on polymers, which film system is simple to produce.

It has been possible to achieve this object by means of the film system according to the invention described more fully below which includes an electroluminescent pigment.

DETAILED DESCRIPTION OF THE INVENTION

In the film system according to the invention, the lighting function is provided by an electroluminescent pigment. The film system according to the invention is flexible and formable, and it is possible to inject one or more polymers onto the back thereof. Moreover, the system according to the invention is transparent and can therefore be used in many fields of application.

The invention provides a light-emitting, transparent and flexible film system based on polymers, which film system is characterised in that it has the following structure and is illustrated in the Figure:

a) a first transparent plastic film 1, b) a first organic, transparent electrode coating 2 disposed on the inside of the first plastic film a), c) a transparent film 3, adjacent to the coating b) and coating d), having a thickness of from 10 to 200 μm, particularly preferably from 20 to 100 μm, comprising (1) a thermoplastic polyurethane having a hardness of from Shore A 75 to Shore D 55 and (2) one or more electroluminescent pigments 4 in an amount of from 5 to 95 wt. %, particularly preferably from 10 to 50 wt. %, based on total weight of the transparent film, d) a second organic, transparent electrode coating 5 disposed on the inside of the plastic film e), and e) a second transparent plastic film 6.

The invention further provides a process for the production of the light-emitting, transparent and flexible film system based on polymers in which a) each of two plastic films that has been coated on one side with an organic transparent electrode material is positioned so that the coated side of each of those plastic films faces the coated side of the other, b) an electrical contact based on a metallic conductor is applied to the transparent electrode material coating of each of the plastic films, and c) a transparent film having a thickness of from 10 to 200 μm, particularly preferably from 20 to 100 μm, comprising thermoplastic polyurethane having a hardness of from Shore A 75 to Shore D 55, preferably from Shore A 75 to Shore A 88, and from 5 to 95 wt. %, particularly preferably from 10 to 50 wt. %, electroluminescent pigments, is laminated to the coated side of each of the plastic films.

The transparent plastic films that are used are each preferably a film based on polycarbonate, polycarbonate blends, polyesters, thermoplastic elastomers and/or thermoplastic polyurethane. The first and second plastic films are preferably made of the same material. As used herein, a plastic film also includes any of the so-called composite films made up of a plurality of films.

The organic transparent electrode material is preferably an electrode based on polyethylenedioxythiophene. Other transparent electrode materials are e.g. indium tin oxides (ITO), polyaniline or conductive inks. The electrode layer should have an electrical conductivity/surface resistance of preferably 100 to 1000 ohm.

The electroluminescent pigment present in the thermoplastic polyurethane film may be any of the known encapsulated or non-encapsulated, preferably non-encapsulated, electroluminescent pigments.

The thermoplastic polyurethane film that is used is preferably a film extruded from thermoplastic polyurethane and the electroluminescent pigment.

The thermoplastic polyurethane that is used should have a hardness of from Shore A 75 to Shore D 55, preferably from Shore A 75 to Shore A 88.

In a preferred embodiment of the present invention, production of the film system is preferably carried out by the following process.

Each of two plastic films, for example polycarbonate films, is coated on one side with an organic, transparent electrode material, such as that which is commercially available under the name Baytron® from H.C. Stark GmbH & Co. KG. Other transparent electrode materials are e.g. indium tin oxides (ITO), polyaniline or conductive inks. The electrode layer should have an electrical conductivity/surface resistance of preferably 100 to 1000 ohm. The coated films are dried and provided with a contact made of a material such as conductive silver. At the same time, an electroluminescent pigment is incorporated into a thermoplastic polyurethane and extruded to form a film having a thickness of from 10 to 200 μm, preferably from 20 to 100 μm. The amount by weight of electroluminescent pigment(s) is from 5 to 95 wt. %, preferably from 10 to 50 wt. %, based on total weight of thermoplastic polyurethane film. Each of the two plastic films coated on one side with conductive polymer, the coated sides of which face one another, and the intermediate TPU film provided with the electroluminescent pigment are then laminated, for example by means of a roller applicator. The lamination is preferably carried out at elevated temperature (e.g., from 80 to 150° C., particularly preferably from 100 to 130° C.). The film system so produced can be used for various applications.

The film systems of the present invention can be formed, and plastics can be injected onto the back thereof. If an alternating voltage (e.g., 110 V, 400 Hz) is applied to the contacts, e.g., by way of an inverter, then the film systems can be used as luminescent systems (luminescent films) or the appropriately formed systems and the moldings, optionally with plastics material injected onto the back, can be used as luminescent components.

The invention is illustrated in greater detail by means of the following example.

EXAMPLE

Extrusion of the electroluminescent TPU film: 5 kg of Desmopan® 588E polyurethane from Bayer MaterialScience AG (Shore hardness A=88, which corresponds to a Shore hardness D of 33) were dried overnight at 100° C. 1 kg of luminescent pigment (Lumilux Blau EL, Honeywell, Art. No. 54503) was added thereto. The components were mixed for about 30 minutes in a drum mixer and the pigments adhered to the plastic granules. Extrusion was carried out in an extruder from Kuhne (three-zone screw: diameter of 37 cm and length of about 890 cm without degassing; rotation of 20 rpm with a current consumption of 8A and at a pressure of 46 bar). The temperature of the melt was 192° C. The casting and cooling roller had a temperature of 15° C. The film take-off speed was 5.4 m/minute. The film had a width of about 25 cm and a thickness of about 60 μm. Coating of the plastic films with a conductive layer: Two 125 μm thick polycarbonate films (Makrolon® from Bayer MaterialScience AG) were coated with the material which is commercially available under the name Baytron® F from H.C. Stark GmbH & Co. KG. The wet film thickness was 24 μm. The wet film was dried at about 120° C. The result was two polycarbonate films which were coated on one side with the mentioned conductive polymer. The surface resistance was 330 Ohm.

Contacting: The plastic films were each provided, on the inside coated with conductive polymer, with a strip of conductive silver lacquer about 5 mm wide. Joining of the films and lamination of the plastic films with the electroluminescent TPU film: The lamination was carried out in a heatable press at 140° C. under a pressure of 90 bar for 8 minutes. The TPU film containing the luminescent pigment was placed between the plastic films coated on the inside with the conductive polymer. The two plastic films were offset so that the strip provided with conductive silver lacquer remained free in each case for contacting.

Test: By application of an alternating voltage (230 V, 2500 Hz), the film system was made to light. The luminance achieved was 2.5 cd/m$^2$ at a maximum radiation of 456 nm.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A light-emitting, transparent and flexible film system based on polymers, comprising a) a first transparent plastic film, b) an organic, transparent electrode coating applied on one side of the plastic film a), c) a transparent film, adjacent to the coating b) and coating d), having a thickness of from 10 to 200 μm comprising a thermoplastic polyurethane having a hardness of from Shore A 75 to Shore D 55 and an electroluminescent pigment in an amount of from 5 to 95 wt. %, based on total weight film c), d) an organic, transparent electrode coating applied on one side of the plastic film e), and e) a second transparent plastic film.

2. The film system of claim 1 in which the thermoplastic polyurethane has a hardness from Shore A 75 to Shore A 88.

3. The film system of claim 1 in which the electroluminescent pigment is present in an amount of from 10 to 50 wt. %, based on total weight of film c).

4. The film system of claim 1 in which transparent film c) has a thickness of from 20 to 100 μm.

5. A luminescent system comprising the film system of claim 1.

* * * * *